United States Patent [19]

Kruger

[11] 4,287,731

[45] Sep. 8, 1981

[54] HANDCUFFS

[75] Inventor: James B. Kruger, Oxford, Conn.

[73] Assignee: Bangor Punta Corporation, Greenwich, Conn.

[21] Appl. No.: 101,388

[22] Filed: Dec. 7, 1979

[51] Int. Cl.[3] ..... E05B 75/00
[52] U.S. Cl. ..... 70/16
[58] Field of Search ..... 70/16, 15, 17, 18, DIG. 55

[56] References Cited

U.S. PATENT DOCUMENTS

| | | | |
|---|---|---|---|
| 1,821,566 | 9/1931 | Neal | 70/16 |
| 1,845,511 | 2/1932 | Neal | 70/16 |
| 2,390,885 | 12/1945 | Kelley | 70/16 |

*Primary Examiner*—Robert L. Wolfe
*Attorney, Agent, or Firm*—Patrick J. Walsh

[57] ABSTRACT

A handcuff with an improved double lock assembly in which the handcuff with conventional pivotal cheek and jaw assembly having a spring element which double locks the handcuff. Additionally, the handcuff has an improved and simplified pivotal mounting for the locking bolt.

6 Claims, 12 Drawing Figures

FIG 5
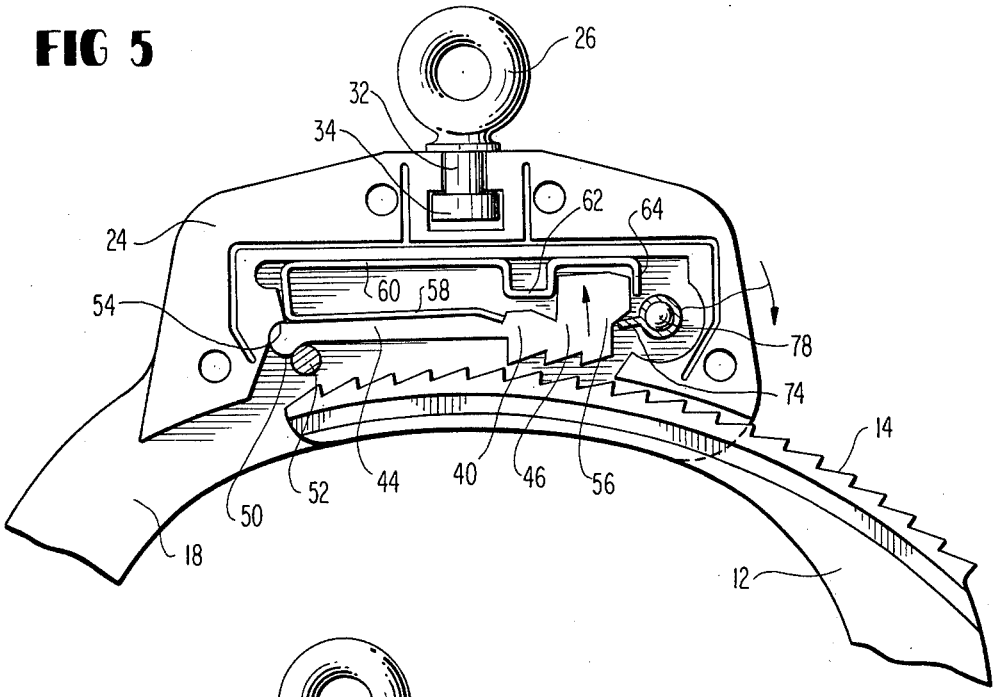
FIG 6
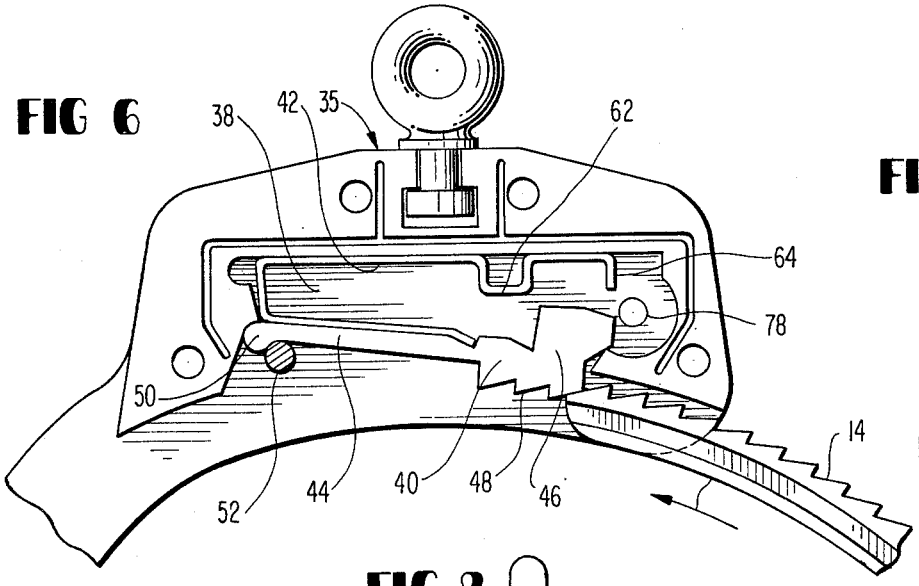
FIG 11
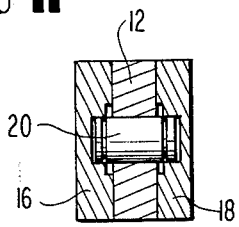
FIG 12
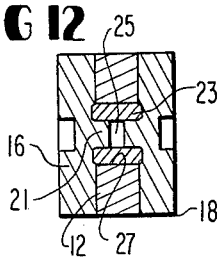
FIG 8
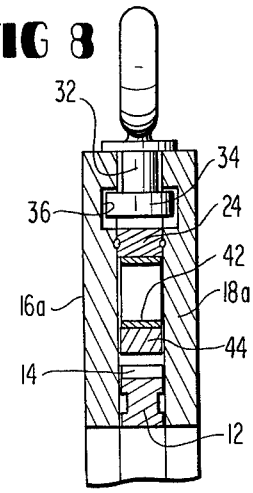
FIG 7
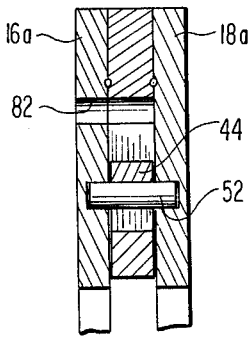
FIG 9
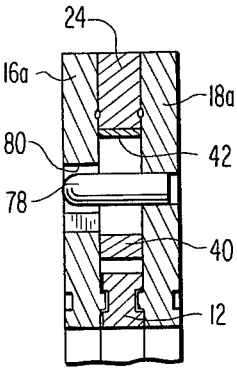
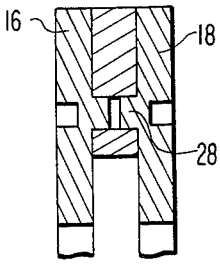
FIG 10

HANDCUFFS

BACKGROUND OF THE INVENTION

The present invention relates to handcuffs for locking about the wrists of an individual and more particularly relates to a handcuff having an improved double lock assembly.

Many different designs for handcuffs have been proposed and constructed in the past including those which feature in each handcuff a double lock assembly, such as described and illustrated in U.S. Pat. No. 2,390,885. In such conventional constructions, for example as noted in that patent, the ends of a pair of arcuate elements known as a cheek and jaw are pivotally coupled to one another. The cheek and jaw are pivotable toward and away from one another between handcuff locked and unlocked positions. A spring biased bolt is also conventionally carried by the cheek and carries teeth which engage in ratchet-like-manner teeth carried by the jaw upon closing the jaw into the cheek to close the handcuff. The meshing teeth, of course, prevent relative movement of the cheek and jaw away from one another and opening of the handcuff.

In U.S. Pat. No. 2,390,885, a double locking assembly is used to prevent the bolt from being lifted from the jaw and against the spring bias applied thereto. Thus, the bolt is maintained in latched engagement with the jaw notwithstanding efforts to lift the bolt from such latching engagement without the aid of a key for the handcuff.

SUMMARY OF THE PRESENT INVENTION

It is a primary object of the present invention to provide a novel and improved handcuff of the foregoing described type and which is greatly simplified in construction.

It is another object of the present invention to provide a novel and improved handcuff of this type having a spring which serves the dual purpose of double locking the handcuff.

It is still another object of the present invention to provide a novel and improved handcuff of this type wherein separate spring and detent mechanisms conventionally required in handcuff assemblies of prior designs for double locking the handcuff are eliminated.

It is a further object of the present invention to provide a handcuff of the type having a pivoted locking bolt wherein an improved and simplified pivotal mounting for the locking bolt is provided.

It is a related object of the present invention to provide a novel and improved handcuff having the foregoing characteristics and which is readily, easily, and economically manufactured, constructed to afford increased strength, and comprised of parts readily and easily assembled one with respect to the other.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the foregoing and other objects and advantages and in accordance with the purposes of the present invention, as embodied and broadly described herein, a handcuff constructed in accordance with the present invention comprises; a generally arcuate cheek carrying a lock assembly at one end thereof, a generally arcuate jaw having teeth at one end thereof, and means for pivotally coupling said cheek and said jaw one to the other at their respective opposite ends to enable relative pivotal movement of the cheek and the jaw toward and away from one another between handcuff closed and open positions respectively, the lock assembly including a bolt having teeth and movable between a locking position with its teeth engaging the teeth carried by the jaw to prevent relative movement of the cheek and the jaw away from one another toward the handcuff open position and an unlocking position with its teeth spaced from the teeth carried by the jaw to enable relative movement of the cheek and the jaw away from one another toward the handcuff open position, and a bolt spring carried by the lock assembly movable between first and second positions, the bolt spring in its first position having a portion engageable with the bolt to bias the bolt for movement toward its locking position and, in its second position, having a detent engageable with the bolt to prevent movement of the bolt into its unlocking position.

Preferably, the bolt spring is carried for linear movement between its first and second positions and comprises a leaf spring reversely formed intermediate its ends to provide a first spring leg engaging the bolt to bias it toward its locking position and a second spring leg which carries a generally U-shaped spring leaf detent portion intermediate its ends. An elongated slot is provided in registry with the spring, when in its first position, to enable translation of a key in the slot to displace the spring from its first to its second double locking position. The spring and bolt preferably carry shoulders respectively engageable by the projection on the key whereby, upon rotation of the key in one direction, the projection on the key engages the spring shoulder to linearly displace the spring from its second position toward its first position and, upon rotation of the key in the opposite direction, the projection on the key engages the bolt shoulder to lift the bolt and unlock the handcuff.

Additionally, the upper surface of the bolt is preferably provided with spaced detents which cooperate with the terminal portion of the first spring leg for the purpose of detaining the bolt spring in open and closed positions so that it will not move when impact forces are applied to the handcuffs. In this way the bolt spring moves only when the key is applied and maintains the desired position until the key is again used.

In another preferred aspect of the present invention, the lock assembly includes a stud spaced from a curved wall of the frame. An enlarged end portion of the bolt is disposed between and engages the stud and curved wall whereby the stud and curved wall provide the pivotal mounting for the bolt.

The accompanying drawings which are incorporated in and constitute a part of this specification, illustrate one embodiment of the invention and, together with the description, serve to explain the principles of the invention.

BRIEF DESCRIPTION OF THE DRAWINGS

FIG. 5 is a view similar to FIG. 3 illustrating the locking assembly in an unlocked condition;

FIG. 6 is a view similar to FIG. 3 illustrating the jaw entering the locking assembly and moving toward a handcuff locked condition;

FIGS. 7, 8, 9, and 10 are enlarged cross-sectional views of the handcuff illustrated in FIG. 1 and taken generally about on lines 7—7, 8—8, 9—9, and 10—10 respectively in FIG. 1; and FIG. 11 is an enlarged cross-sectional view of the pivot assembly for the cheeks and jaw taken generally about on line 11—11 in FIG. 1.

FIG. 12 is a cross-sectional view of a modifed pivot assembly for the cheeks and jaw.

DESCRIPTION OF A PREFERRED EMBODIMENT

Reference will now be made in detail to the preferred embodiment of the present invention, an example of which is illustrated in the accompanying drawings.

Figure 1:
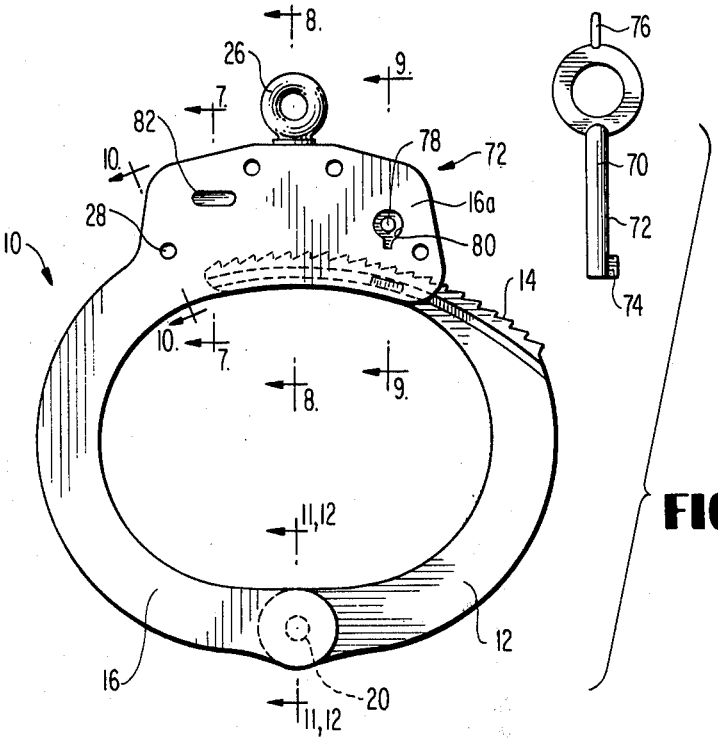
FIG. 1 is a side elevational view of a handcuff constructed in accordance with the present invention and further illustrating a key therefor.
Figure 2:
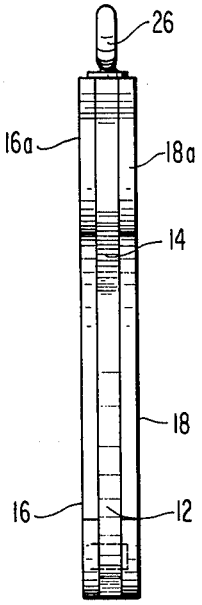
FIG. 2 is an end elevational view of the handcuff illustrated in FIG. 1.

Referring now to FIGS. 1 and 2, there is illustrated a handcuff constructed in accordance with the present invention and generally designated 10, it being appreciated that only one such handcuff normally comprising a pair thereof chained one to the other is described and illustrated herein. Handcuff 10 includes a generally arcuate jaw 12 having ratchet-like teeth 14 at one and and pivotally connected at its opposite end between generally arcuate front and back cheeks 16 and 18, respectively. This pivotal connection includes, as illustrated in FIG. 11 a joint stud 20 suitably secured in recesses formed in the opposed and registering ends of cheeks 16 and 18 and an aperture through jaw 12.

The pivotal connection may alternatively be arranged as shown in FIG. 12 wherein a toroidal spacer-washer 19 receives spaced, confronting protrusions 21, 23 on cheeks 16 and 18. The protrusions are affixed to the bore 25 of the spacer-washer by brazing so that the jaw 12 rotates with respect to the outer surface 27 of the spacer-washer.

Cheeks 16 and 18 terminate at their opposite ends in enlarged heads 16*a* and 18*a* which form part of the lock assembly, generally indicated 22. Lock assembly 22 includes a frame 24, preferably a metal plate, disposed between cheek heads 16*a* and 18*a*. As illustrated, frame 24 has the same general outline as the cheek heads which straddle frame 24. A swivel 26 is secured to the frame and cheek heads and projects therefrom for attachment to a chain, not shown, in a conventional manner.

To obtain increased strength in the construction of lock assembly 22 and the joining of the cheek heads and frame one to the other, each cheek head is provided with a plurality of inwardly extending bosses or protrusions 28 which are received in registering apertures 30 formed in frame 24. In forming frame 24, a generally T-shaped slot 35 is provided through its top to receive the shank and base portions 32 and 34, respectively, of swivel 26. To accommodate the enlarged width of the base 34, the interior faces of cheeks 16*a* and 18*a* registrable with base 34 upon final assembly are recessed at 36, as best illustrated in FIG. 8, to receive the margins of base 34 which exceed the width of frame 24. Frame 24 is formed to provide a recess along its underside and defines, with the sides of cheek heads 16*a* and 18*a*, a chamber or cavity 38 housing the working parts of lock assembly 22. In final assembly, the cheek heads and frame 24 are aligned and brazed one to the other with the bosses 28 received in the registering apertures 30 and base portion 34 of swivel 26 in the base of T-shaped slot 35.

Lock assembly 22 includes a bolt 40 and a bolt spring 42 both disposed in cavity 38. Bolt 40 comprises an elongated shank 44, a head 46 having teeth 48 along its underside for engaging the teeth 14 carried by jaw 12, and an enlarged generally circular hub 50 at its end remote from head 46. In accordance with the present invention, bolt 40 is pivotally secured to the cheeks and frame by a stud 52 secured between cheek heads 16*a* and 18*a* and a shaped recess 54 on frame 24. Particularly, stud 52 extends below hub 50 and provides a pivotal support therefor. Recess 54 is defined by a circular wall portion which lies on the opposite side of hub 50 from stud 52. Thus, stud 52 and wall 54 define a bearing for hub 50 and about which bolt 40 pivots. For reasons discussed hereinafter, head 46 of bolt 40 carries a shoulder 56 adjacent its forward edge. In addition, upper surface 57 of the bolt has spaced detents 59, 61 for a purpose now to be described.

Figure 3:
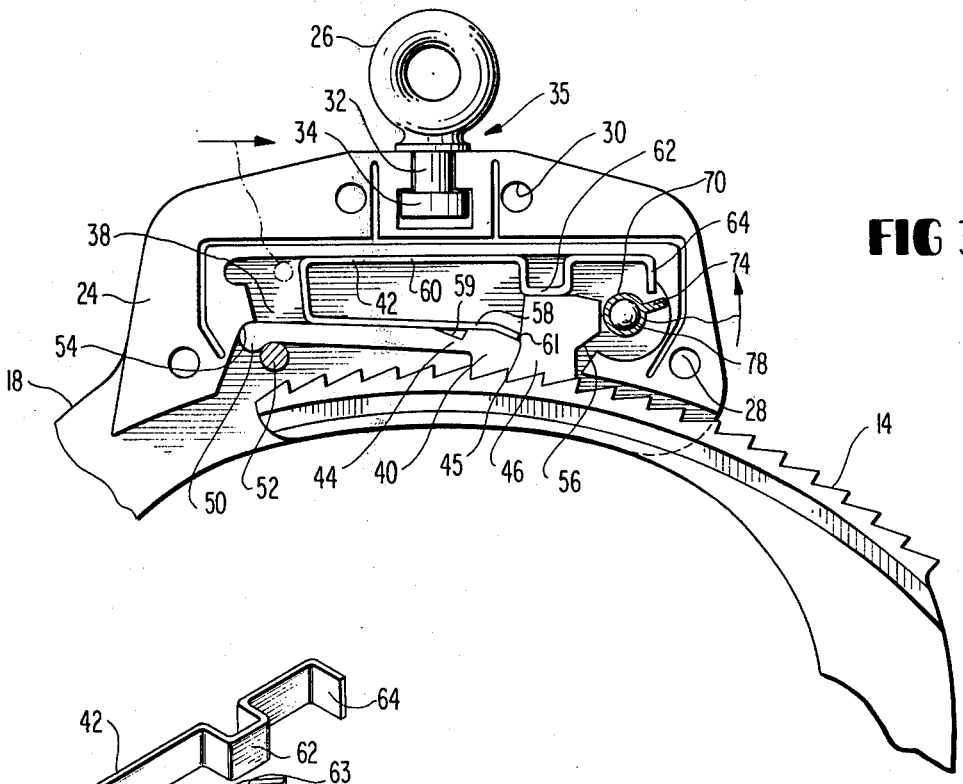
FIG. 3 is a fragmentary enlarged view of the handcuff with the front cheek removed and illustrating the lock assembly of the handcuff in its double locked condition.
Figure 4:
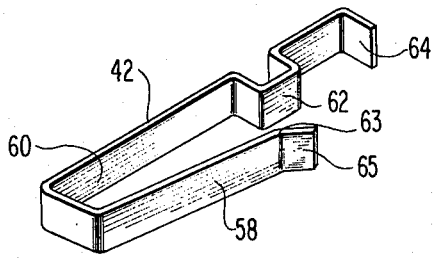
FIG. 4 is a perspective view of a bolt spring constructed in accordance with the present invention and utilized in the lock assembly hereof.

Bolt spring 42 comprises an elongated strip of metal reversely formed, e.g., bent, intermediate its ends to provide first and second spring leg portions 58 and 60, respectively. When bolt spring 42 is disposed in cavity 38 as best illustrated in FIGS. 3, 5, and 6, first spring leg portion 58 bears against shank 44 of bolt 40 to bias it for pivotal movement in a clockwise direction tending to move the bolt into a locking position with teeth 48 engaging teeth 14 of jaw 12. The first spring leg portion 58 is bent along line 63 to define tab 65 (best shown in FIG. 3) which cooperates detents 59 and 61 to prevent linear movement of the bolt spring except when the bolt spring is moved by key. Second spring leg portion 60 bears against the base of cavity 38, e.g., the underside of frame 24. Second spring leg portion 60 also carried a detent 62 for locking bolt 40 in its locked position. Particularly, second spring leg portion 60 is formed, e.g., bent, intermediate its length to provide a generally U-shaped spring leaf portion extending toward first spring leg portion 58 for engagement with the top of head 46 in a manner described in detail hereinafter. For reasons also discussed hereinafter, the distal end or tip of second spring leg portion 60 is formed, e.g., bent, to terminate in a shoulder or flange 64 and which flange 64 extends in a direction toward first spring leg portion 50.

It will be appreciated from a review of FIGS. 3 and 6 that bolt spring 42 is carried for linear sliding movement lengthwise within cavity 38 between first and second positions, respectively. Particularly, first spring leg portion 58 is adapted to slide along the upper face of shank 44 of bolt 40. Bolt spring tab 65 engages detent 59 (FIG. 6) in the first position to prevent linear sliding movement of the bolt spring without the handcuff key as by application of impact forces to the handcuff. Tab 65 also cooperates with detent 61 in the second position for the same purpose (FIG. 3). In this way the bolt spring may be moved only by the key and the handcuffs avoid the undesirable need to move the bolt spring to the first position (FIG. 6) prior to handcuffing a subject. Second spring leg portion 42 is slidable along the flat underside of frame 24, the opposite ends of spring 42 butting the ends of frame 24 and defining the end limits of its linear displacement.

Referring now to FIGS. 1, 3, and 9, there is provided a key 70 having a shank 72 with a radial projection 74 at one end and an axial projection or pin 76 at its opposite end. The end of key 70 carrying projection 74 is axially recessed for engagement about a pin 78. Pin 78 is secured to cheek head 18*a* and projects across cavity 38 into a key opening 80 formed in cheek head 16*a*, as best illustrated in FIG. 9. Cheek head 16*a* has an elongated slot 82 therethrough adjacent the opposite end of cavity 38 for reasons which will become clear from the ensuing description.

In order to close handcuff 10 hereof, jaw 12 is moved toward and its free end is moved between cheeks 16 and 18. From a review of FIG. 6, teeth 14 of jaw 12 will slide past the teeth 48 carried by bolt head 46 in a ratchet-like manner. When handcuff 10 is fully closed, bolt 40 is biased by spring 42 to maintain the teeth 48 of bolt 40 engaged with teeth 14 of jaw 12 thus locking handcuff 10 in its closed position and preventing movement of jaw 12 away from cheeks 16 and 18. This action provides a single lock for the handcuff 10.

To double lock the handcuff 10 hereof in its closed position, bolt spring 42 is linearly displaced, from a first position illustrated in FIG. 6, to a second position illustrated in FIG. 3. To accomplish this, pin 76 on key 70 is inserted through slot 82 to engage behind bolt spring 42. By translating key 70, for example from left to right in slot 82 as illustrated in FIG. 3, spring 42 is displaced linearly along cavity 38 into the position illustrated in FIG. 3. In that position, detent 62 is located in registry with or opposite head 56 of bolt 40. This prevents bolt 40 from pivoting toward an unlocked position with teeth 48 disengaged from teeth 14. Thus, the bias of spring 42 serves to maintain bolt 40 in the handcuff locked position illustrated in FIG. 3 while simultaneously detent 62 prevents bolt 40 from pivoting from its locking position vis-a-vis jaw 12 toward its unlocked position illustrated in FIG. 5. Thus, spring 42 serves as a double lock for handcuff 10.

To unlock handcuff 10 and enable jaw 12 and cheeks 16 and 18 to pivot about stud 20 in a direction away from one another, key 70 is inserted into key slot 80. By rotating key 70, for example in a counterclockwise direction as indicated by the arrow in FIG. 3, projection 74 on key 70 engages flange 64 at the end of second spring leg 68. Upon continued rotation of key 70 in that direction, bolt spring 42 is linearly displaced, for example from right to left as illustrated in FIG. 3, into the position illustrated in FIG. 6. This latter linear displacement misaligns detent 62 with head 46 such that the bolt head 46 registers with the space along spring leg portion 68 between detent 62 and flange 64. Thus, while the additional detenting action is removed, the bias of spring 42 urges bolt 40 into engagement with jaw 12 to maintain the handcuff in its locked condition. One spring 42 is displaced to the left as described, key 70 is then rotated in the opposite direction, e.g., clockwise as illustrated in FIG. 5, to bring projection 74 into engagement with shoulder 56 on bolt head 46. Continued rotation of the key 70 in that direction lifts or pivots bolt 40 to remove teeth 48 from engagement with teeth 14. Thus, jaw 12 is free for movement away from cheeks 16 and 18 whereby handcuff 10 may be opened. In the course of double locking and unlocking the bolt spring, the key exerts sufficient force to overcome the frictional resistance between the tab 65 and each of the detents 59 and 61.

Consequently, it will be appreciated that the objects of the present invention are fully accomplished in that there has been provided in the foregoing described handcuff construction a bolt spring which serves a dual purpose. First, bolt spring 42 serves to bias bolt 40 into locking engagement with jaw 12 thus locking handcuff 10 in its closed position. This single locking action is, of course, sufficient to lock handcuff 10 in its closed position, but if greater security is desired, spring 42 can be displaced in the manner described and illustrated to detent bolt 40 in its locked position. Thus, the spring serves also to double lock the handcuff. The foregoing is also provided utilizing a minimum number of parts in its construction and operation. Further, by mounting the bolt for pivotal movement between stud 52 and recess 54, final assembly of the handcuff parts is greatly simplified and facilitated.

It will be apparent to those skilled in this art that various modifications could be made in the handcuff hereof without departing from the scope or spirit of the invention.

What is claimed is:

1. A handcuff comprising:

a generally arcuate cheek carrying a lock assembly at one end, a generally arcuate jaw having teeth at one end, means for pivotally coupling said cheek and said jaw one to the other at their respective opposite ends to enable relative pivotal movement of said cheek and said jaw toward and away from one another between handcuff closed and open positions, respectively, said lock assembly including a bolt having teeth and movable between a locking position with its teeth engaging the teeth carried by said jaw to prevent relative movement of said cheek and said jaw away from one another toward the handcuff open position and an unlocking position with its teeth spaced from the teeth carried by said jaw to enable relative movement of said cheek and said jaw away from one another toward the handcuff open position, a bolt spring carried by said lock assembly for biasing said bolt for movement toward its locking position, and means adjacent an end of said bolt for mounting said bolt for pivotal movement between said locking and unlocking position, said mounting means including a stud extending in a direction parallel to the pivotal axis of said bolt and a frame having a curved wall in spaced opposition to said stud, said bolt end having an enlarged portion between the engaging said wall and said stud and providing the sole means for pivotally coupling said bolt in said handcuff.

2. A handcuff according to claim 1 including means carried by said spring for double locking said bolt in its locking position.

3. A handcuff comprising:

a generally arcuate cheek carrying a lock assembly at one end, a generally arcuate jaw having teeth at one end, and means for pivotally coupling said cheek and said jaw one to the other at their respective opposite ends to enable relative pivotal movement of said cheek and said jaw toward and away from one another between handcuff closed and open positions, respectively, said lock assembly including a bolt having teeth and being pivotally movable between a locking position with its teeth engaging the teeth carried by said jaw to prevent relative movement of said cheek and said jaw away from one another toward the handcuff open position and an unlocking position with its teeth spaced from the teeth carried by said jaw to enable relative movement of said cheek and said jaw away from one another toward the handcuff open position, and a bolt spring carried by said lock assembly for linear movement between the first and second positions, said bolt spring in said first position having a portion engageable with said bolt to bias said bolt for movement toward its locking position and in its second position having a detent engageable with said bolt to prevent movement of said bolt into its unlocking position, said bolt spring comprising a leaf spring substantially reversely formed intermediate its ends to provide a first spring leg engaging said bolt and biasing the latter toward its locking position and a second spring leg carrying said detent, said bolt having a head on the side thereof opposite its teeth and engageable with said detent when said bolt spring lies in its second position to preclude pivotal movement of said bolt into its unlocking position.

4. A handcuff comprising:

a generally arcuate cheek carrying a lock assembly at one end, a generally arcuate jaw having teeth at one end, and means for pivotally coupling said cheek and said jaw one to the other at their respective opposite ends to enable relative pivotal movement of said cheek and said jaw toward and away from one another between handcuff closed and open positions, respectively, said lock assembly including a bolt having teeth and movable between a locking position with its teeth engaging the teeth carried by said jaw to prevent relative movement of said cheek and said jaw away from one another toward the handcuff open position and an unlocking position with its teeth spaced from the teeth carried by said jaw to enable relative movement of said cheek and said jaw away from one another toward the handcuff open position, means adjacent an end of said bolt for mounting said bolt for pivotal movement between said locking and unlocking positions, said mounting means including a stud extending in a direction parallel to the pivotal axis of said bolt and a frame having a curved wall in spaced opposition to said stud, said bolt end having an enlarged portion disposed between and engaging said wall and said stud and providing the sole means for pivotally coupling said bolt in said handcuff, and a bolt spring carried by said lock assembly and movable between first and second positions, said bolt spring in said first position having a portion engageable with said bolt to bias said bolt for movement toward its locking position and in its second position having a detent engageable with said bolt to prevent movement of said bolt into its unlocking position.

5. A handcuff according to claim 3 wherein said detent comprises a generally U-shaped leaf portion extending away from the second spring leg in a direction toward said bolt, said U-shaped spring leaf portion being offset from said bolt head when said bolt spring lies in its first position and lying in registration with said bolt head when said bolt spring lies in its second position.

6. A handcuff according to claim 5 wherein the tip of said second spring leg is formed in a direction toward said bolt to define a shoulder, a key having a projection, said cheek having an opening for receiving said key and said cheek having an opening for receiving said key and said projection, said bolt having a shoulder, said projection being engageable with the shoulder on said bolt spring to displace said bolt spring from its second position toward its first position upon rotation of said key in one direction and engageable with the shoulder on said bolt for displacing said bolt from its locked position toward its unlocked position upon further rotation of said key in the opposite rotational direction.

* * * * *